US011206728B2

(12) United States Patent
Krajnc et al.

(10) Patent No.: US 11,206,728 B2
(45) Date of Patent: Dec. 21, 2021

(54) LIGHTING CONTROL

(71) Applicant: SIGNIFY HOLDING B.V., Eindhoven (NL)

(72) Inventors: Hugo Jose Krajnc, Eindhoven (NL); Remco Magielse, Tilburg (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 237 days.

(21) Appl. No.: 16/304,712

(22) PCT Filed: May 23, 2017

(86) PCT No.: PCT/EP2017/062404
§ 371 (c)(1),
(2) Date: Nov. 27, 2018

(87) PCT Pub. No.: WO2017/207351
PCT Pub. Date: Dec. 7, 2017

(65) Prior Publication Data

US 2020/0329546 A1 Oct. 15, 2020

(30) Foreign Application Priority Data

May 30, 2016 (EP) ..... 16171931

(51) Int. Cl.
*H05B 47/19* (2020.01)

(52) U.S. Cl.
CPC ..... *H05B 47/19* (2020.01)

(58) Field of Classification Search
CPC ..... H05B 47/19
See application file for complete search history.

(56) References Cited

U.S. PATENT DOCUMENTS

| | | | |
|---|---|---|---|
| 8,115,398 B2 | 2/2012 | Draaijer et al. | |
| 9,041,296 B2 | 5/2015 | Yianni et al. | |
| 2011/0312311 A1 | 12/2011 | Abifaker et al. | |
| 2012/0034934 A1* | 2/2012 | Loveland | H04L 67/18 455/456.3 |

FOREIGN PATENT DOCUMENTS

| | | |
|---|---|---|
| WO | 2010122440 A2 | 10/2010 |
| WO | 2014060901 A1 | 4/2014 |
| WO | 2014118432 A1 | 8/2014 |
| WO | 2015113833 A1 | 8/2015 |
| WO | 2015114123 A1 | 8/2015 |
| WO | 2015185402 A1 | 12/2015 |

* cited by examiner

*Primary Examiner* — Alexander H Taningco
*Assistant Examiner* — Pedro C Fernandez

(57) ABSTRACT

Apparatus for controlling a plurality of lighting devices to emit light, the controller comprising: a lighting interface for transmitting control commands to each of the plurality of lighting device in order to control the plurality of lighting devices; and a controller configured to: obtain orientation information indicative of an orientation of a user device and based thereon determine the orientation of the user device; obtain location information indicative of a location of the user device and based thereon determine the location of the user device; process the determined orientation of the user device and the determined location of the user device to determine one or more lighting settings for one or more of the plurality of lighting devices; and selectively control, via the lighting interface, the one or more lighting devices to emit light in accordance with the one or more determined lighting settings.

20 Claims, 8 Drawing Sheets

LIGHTING CONTROL

CROSS-REFERENCE TO PRIOR APPLICATIONS

This application is the U.S. National Phase application under 35 U.S.C. § 371 of International Application No. PCT/EP2017/062404, filed on May 23, 2017, which claims the benefit of European Patent Application No. 16171931.5, filed on May 30, 2016. These applications are hereby incorporated by reference herein.

TECHNICAL FIELD

The present disclosure relates to techniques for automatically and dynamically controlling one or more lighting devices.

BACKGROUND

A number of techniques exist for controlling one or more lighting devices such as the luminaires illuminating a room or other environment, e.g. to switch the lights on and off, dim the light level up and down, or set a colour setting of the emitted light.

One technique is to use remote controls and switches to control the lighting devices. Traditional switches are static (usually mounted to a wall) and connected to one or more lighting devices by a wired connecting. Remote controls, on the other hand, transmit wireless signals (e.g. infrared communication signals) to wireless device in order to control the lighting, thus allowing a user slightly more freedom in that they may control the lighting devices from anywhere within wireless communication range.

Another technique is to use an application running on a user terminal such as a smartphone, tablet, or laptop or desktop computer. A wired or wireless communication channel is provided between the user terminal and a controller of the lighting device(s), typically an RF channel such as a Wi-Fi, ZigBee or Bluetooth channel in the case of a mobile user terminal. The application is configured to use this channel to send lighting control requests to the controller, based on manual user inputs entered into the application running on the user terminal. The controller then interprets the lighting control requests and controls the lighting devices accordingly. Note that the communication channel via which the controller controls the lighting devices may be different from the communication channel provided between the user terminal and the controller. For example, WiFi may be used between the user terminal and the controller, and ZigBee between the controller and the lighting devices.

One disadvantage of this technique is that it is not very user friendly.

Another technique for controlling lighting devices is gesture control. In a system employing gesture control, the system is provided with suitable sensor equipment such as a 2D video camera, a stereo video camera, a depth-aware (ranging) video camera (e.g. time-of-flight camera), an infrared or ultrasound based sensing device, or a wearable sensor device (e.g. a garment or accessory incorporating one or more accelerometers and/or gyro sensors). A gesture recognition algorithm running on the controller receives the input from the sensor equipment, and based on this acts to recognise predetermined gestures performed by the user and map these to lighting control requests. This is somewhat more natural for the user, but still requires explicit, manual user input in that the user must remember the appropriate gesture for their desired lighting control command and consciously and deliberately perform that gesture. In this sense, a "gesture" may be considered an intentional action performed by the user. For example, pointing towards a lamp, or waving his hands to dim up/down a light.

Some techniques do exist for automatically controlling the lights in a building or room, or the like. These involve detecting the presence of a user by means of a presence detector such as a passive infrared sensor or active ultrasound sensor. However, these techniques tend to be quite crude in that they only detect whether or not a user is present in a certain predefined zone of the building or room, and simply turn the lights on or off or dim them up and down in dependence on whether or not present.

SUMMARY

It would be desirable to find an alternative technology for automatically controlling one or more lighting devices to be controlled by a user which allows for lighting to follow a user in a seamless way without the user having to "trigger" it, e.g. using gestures.

Hence according to one aspect disclosed herein, there is provided an apparatus for controlling a plurality of lighting devices to emit light, the controller comprising: a lighting interface for transmitting control commands to each of the plurality of lighting devices in order to control the plurality of lighting devices; and a controller configured to: obtain orientation information indicative of an orientation of a user device and based thereon determine the orientation of the user device; obtain location information indicative of a location of the user device and based thereon determine the location of the user device; process the determined orientation of the user device and the determined location of the user device to determine one or more lighting settings for one or more of the plurality of lighting devices; and selectively control, via the lighting interface, the one or more lighting devices to emit light in accordance with the one or more determined lighting settings.

In embodiments, said processing comprises determining a respective direction, from the location of the user device, of a respective lighting effect location of each of the one or more lighting devices, said direction being relative to the determined orientation of the user device.

In embodiments, the lighting effect location of a lighting device is substantially co-located with the respective lighting device.

In embodiments, said processing comprises determining a set of lighting devices being within a field of view of the user device, by determining whether each respective direction is within a threshold angular range defining the field of view.

In embodiments, the one or more lighting settings comprise at least a first lighting setting for the set of lighting devices within the field of view of the user device.

In embodiments, said processing comprises determining one or more lighting devices not being within the field of view of the user device, and the one or more lighting settings also comprise a second lighting setting for the one or more lighting devices not being within the field of view of the user device.

In embodiments, the controller is further configured to obtain an indication of a user preference and process the obtained indication along with the received orientation information and the received location information to determine the one or more lighting settings.

In embodiments, said indication of the user preference is input by a user of the user device and obtained by receiving the indication from the user device.

In embodiments, said indication of the user preference is stored in a memory and obtained by retrieving the indication from the memory.

In embodiments, the user preference specifies at least the first lighting setting.

In embodiments, the user preference further specifies the second lighting setting.

In embodiments, the first lighting setting is a turn on or dim up lighting setting, and wherein the second lighting setting is a turn off or dim down lighting setting.

In embodiments, the controller is further configured to determine a respective distance from the user device to of each of the one or more lighting devices, and not control lighting devices which are determined to be further from the user device than a threshold distance.

According to another aspect disclosed herein, there is provided a method of controlling a plurality of lighting devices to emit light, the method comprising steps of: receiving orientation information indicative of an orientation of a user device and based thereon determine the orientation of the user device; receiving location information indicative of a location of the user device and based thereon determine the location of the user device; process the determined orientation of the user device and the determined location of the user device to determine one or more lighting settings for one or more of the plurality of lighting devices; and selectively control the one or more lighting devices to emit light in accordance with the one or more determined lighting settings.

According to another aspect disclosed herein, there is provided a computer program product comprising computer-executable code embodied on a non-transitory storage medium arranged so as when executed by one or more processing units to perform the steps according to any method disclosed herein.

BRIEF DESCRIPTION OF THE DRAWINGS

To assist understanding of the present disclosure and to show how embodiments may be put into effect, reference is made by way of example to the accompanying drawings in which.

DETAILED DESCRIPTION OF EMBODIMENTS

Figure 1:
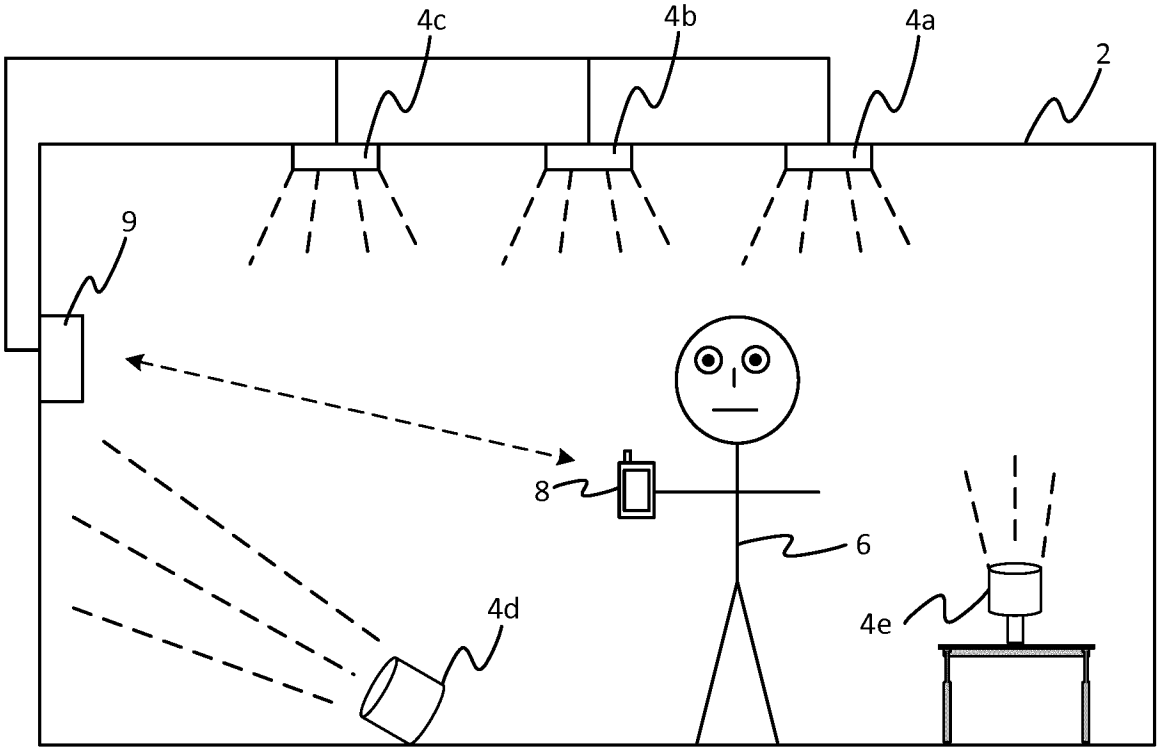
FIG. 1 is a schematic diagram of an environment including a lighting system and user.

Modern lighting systems are becoming more complex. The amount and variety of features available increases periodically (e.g. with new software releases), and so does the complexity linked to controlling such a system. In many cases users can feel overwhelmed by the sudden excess of functionalities. There is therefore a need to not only think of new and differentiating features, but also to provide clear, simple, and intuitive ways to control and activate them.

The most common control source for such systems are smartphones or tablets running custom apps which give users access to all features of the system. However, this presents some limitations as not every user walks around his/her house carrying around his/her phone, the device's battery might be depleted, or it simply takes too much time to trigger a light setting when entering a room. Furthermore, a user's hands may not always be free and able to operate the lighting system via manual input.

Additionally, most users are not experts in terms of lighting design. When creating or recalling a specific scene for a room this is done mostly taking into account the subjective visual effect that the users perceive and not necessarily taking into account the best device performance or design effect. This can sometimes lead to user frustration when moving into a new room since recreating the same general ambiance can be time consuming or simply doesn't match what the user was seeing before.

The present invention simplifies and addresses these challenges by determining what light settings the user is subjected to and dynamically redeploying them as the user moves to such that he/she perceives the same overall ambiance. E.g. so that lighting in front of the user is substantially constant even when the user is moving and rotating within an environment. This might involve turning on or dimming up the lighting devices which are in front of the user (e.g. within a field of view FoV) and/or turning off or dimming down the lighting devices which are behind the user (e.g. outside the FoV). For example, the apparatus for controlling a plurality of lighting devices to emit light may determine the current light settings that a user is exposed to. The apparatus can do such by, for example, polling a lighting controller or other components of the lighting system to determine their current output or the apparatus can do so by determining which scene has been set (e.g. by the user using a user interface or automatically by the system). The apparatus may be aware what scene has been set as it may comprise, for example, a user interface. For example, the apparatus may be embedded in the user device. On such a user device a first application may run which allows a user to select a scene or otherwise control the output of lighting devices (of a lighting system), and the claimed computer program product may run as a second application, be part of the first application, or run in the background (e.g. as a service). The user can then use the user device to e.g. select a scene and as the user moves and rotates in the environment in which the light output (e.g. the scene) is rendered, the lighting devices are controlled such that the ambiance the user experiences is kept substantially constant. By this it is meant generally that lighting effects (e.g. as part of a scene) that are rendered in the first field of view of the user at a first moment in time when the user faces a first direction at a first position in the environment in which the lighting effect is rendered, will be visible to the user in the user's second field of view when the user moves to a second position facing a second direction. Obviously, as the number and position of lighting devices in a first part of the environment and a second part of the environment may vary. The lighting effects (e.g. as part of a scene) will follow the user's field of view to the extent possible, thus the apparatus may determine and render an approximation of the optimal mapping of light effects in the environment as the user moves and rotates.

FIG. 1 illustrates an example lighting system in accordance with embodiments of the present disclosure. The system is installed or disposed in an environment 2, e.g. an interior space of a building comprising one or more rooms and/or corridors, or an outdoor space such as a garden or park, or a partially covered space such as a gazebo, or indeed other any other space such as the interior of a vehicle. The system comprises a control apparatus 9 and one or more controllable lighting devices 4 coupled to the control apparatus 9 via a wireless and/or wired connection, via which the control apparatus 9 can control the lighting devices 4. Five lighting devices 4*a*, 4*b*, 4*c*, 4*d* and 4*e* are illustrated in FIG. 1 by way of example, but it will be appreciated that in other embodiments the system may comprise other numbers of lighting devices 4 under control of the control apparatus 9, from a single lighting device up to tens, hundreds or even thousands. In the example of FIG. 1, three lighting devices, 4*a*, 4*b* and 4*c* are downlights installed in or at the ceiling and providing downward illumination. Lighting device 4*d* is a wall-washer type lighting device providing a large illumination on a wall. Note that the location of the lighting effect generated by lighting device 4*d* and the location of lighting device 4*d* itself are distinct locations, i.e. lighting device 4*d* providing a lighting effect which is not necessarily at the same location as lighting device 4*d* itself. Lighting device 4*e* is a standing lighting device such as a desk lamp or bedside table lamp. In embodiments, each of the lighting devices 4 represents a different luminaire for illuminating the environment 2, or a different individually controllable light source (lamp) of a luminaire, each light source comprising one or more lighting elements such as LEDs (a luminaire is the light fixture including light source(s) and any associated housing and/or socket—in many cases there is one light source per luminaire, but it is not excluded that a given luminaire could comprise multiple independently controllable light sources such as a luminaire having two bulbs). For example each luminaire or light source 4 may comprise an array of LEDs, a filament bulb, or a gas discharge lamp. The lighting devices 4 may also be able to communicate signals directly between each other as known in the art and employed for example in the ZigBee standard.

The control apparatus 9 may take the form of one or more physical control units at one or more physical locations. For example, the control apparatus 9 may be implemented as a single central control apparatus connected to the light sources 4 via a lighting network (e.g. on the user device 8, on a lighting bridge, or on a central server comprising one or more server units at one or more sites), or may be implemented as a distributed controller, e.g. in the form of a separate control unit integrated into each of the lighting devices 4. The control apparatus 9 could be implemented locally in the environment 2, or remotely, e.g. from a server communicating with the lighting devices 4 via a network such as the Internet, or any combination of these. Further, the control apparatus 9 may be implemented in software, dedicated hardware circuitry, or configurable or reconfigurable circuitry such as a PGA or FPGA, or any combination of such means. In the case of software, this takes the form of code stored on one or more computer-readable storage media and arranged for execution on one or more processors of the control apparatus 9. For example the computer-readable storage may take the form of e.g. a magnetic medium such as a hard disk, or an electronic medium such as an EEPROM or "flash" memory, or an optical medium such as a CD-ROM, or any combination of such media. In any case, the control apparatus 9 is at least able to receive information from a user device 8 of a user 6 and send information to one or more of the plurality of lighting devices. However, it is not excluded that the control apparatus 9 may also be able to send information to the user device 8 and/or receive information from one or more of the plurality of lighting devices.

The user device 8 may be a smartphone, tablet, smart glasses or headset, smart watch, virtual reality (VR) goggles, or any other mobile computing device which the user 6 may carry with them within the environment 2. As is known in the art, the user device 8 may comprise various sensors such as a location sensor and an orientation sensor. The device 8 may also be a remote control, as described above in relation to known remote control systems, fitted with one or more sensors. For example, a battery powered switch comprising an accelerometer. Note that a remote control may or may not have a user interface such as a screen.

As used herein, the term "location sensor" is used to refer to any means by which the location of the user device 8 is able to be determined. Examples of methods by which the location of the user device 8 may be determined include device-centric, network-centric, and hybrid approaches, which are all known in the art and so only described briefly here.

In device-centric methods, the user device 8 communicates wirelessly with at least one beacon of a location network and calculates its own location. E.g. by receiving a beacon signal from the at least one beacon and using known techniques such as triangulation, trilateration, multilateration, finger-printing etc. using measurements of the at least one beacon signal such as time-of-flight (ToF), angle-of-arrival (AoA), received signal strength (RSS) etc., or a combination thereof to calculate its own location. The beacons may be dedicated beacons placed around the environment for use in a local or private positioning network or may be beacons which form part of a wider or public positioning network such as GPS. Any or all of the beacons may be embedded or integrated into one or more of the lighting devices 4. Hence, the beacons may use the same communication channels as the lighting network. In this sense, it is understood that the location network does not have to be a separate network from the lighting network; the location and lighting networks may be partially or entirely integrated. The calculated location may be relative to the at least one beacon, or may be defined on another reference frame (e.g. latitude/longitude/altitude), or converted from one reference frame to another as is known in the art. In other words, the beacons transmit signals which are received by the mobile device 8, and the mobile device 8 then takes a measurement of each signal such as ToF, AoA or RSS and uses these measurements to determine its own location.

In network-centric methods, the user device 8 communicates with at least one beacon of a location network and the location of the user device is calculated by the network (e.g. a location server of the location network). For example, the user device 8 can broadcast a signal which is received by at least one beacon of the location network. ToF, AoA, RSS information etc. or a combination thereof can then be used by the network to determine the location of the user device 8. The user device location may or may not then be provided to the user device 8, depending on the context.

In the device-centric and network-centric approaches, the party (the device or the network) taking the ToF, AoA, RSS etc. measurement(s) is also the party calculating the location of the user device 8. Hybrid approaches are also possible in which one party takes the measurements, but these measurements are then transmitted to the other party in order for the other party to calculate the location of the mobile device 8. For example, at least one beacon of a location network could receive a wireless communication from the mobile device 8 and take at least one of a ToF, AoA, RSS measurement and then send the measured value(s) to the user device 8 (possibly via a location server of the location network). This then enables the user device 8 to calculate its own location.

Similarly to the term "location sensor" described above, the term "orientation sensor" is used to refer to any means by which the orientation of the user device 8 is able to be determined. The determined orientation may be an orientation in 3D space, or may be an orientation on a 2D surface such as the floor of an environment. Orientation measurements may be taken directly by sensors on the user device 8 such as a compass, magnetometer, gyrosensor or accelerometer, or may be derived from successive location measurements which allow a current heading to be determined. For example, a compass on the user device 8 can use measurements of the Earth's magnetic field to determine the orientation of the user device 8 relative to magnetic north. These measurements can then be sent to the control apparatus 9 via wireless means or by wired means if the control apparatus 9 is implemented on the user device 8 itself.

Figure 2:
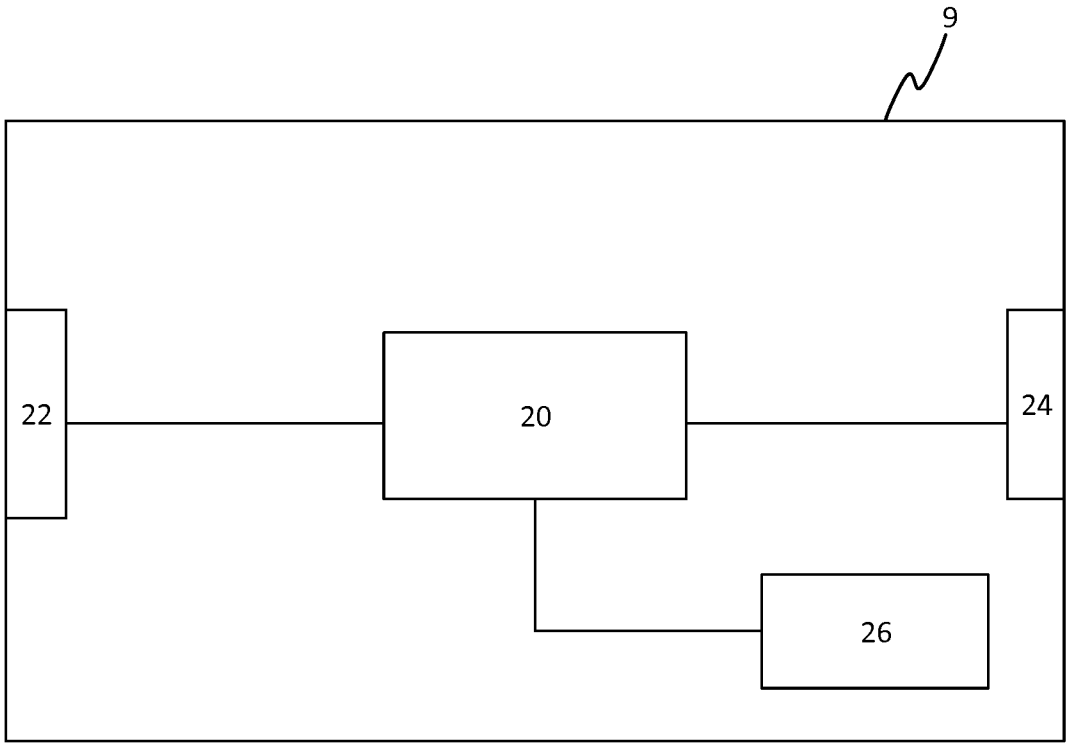
FIG. 2 is a schematic diagram of an apparatus for controlling a plurality of lighting devices.

FIG. 2 shows a schematic diagram of the control apparatus 9. The control apparatus 9 comprises a controller 20, an input interface 22, an output interface 24, and a memory 26. It is appreciated that FIG. 2 is a functional diagram in that each element represents only a functional block of the control apparatus 9. As mentioned earlier, the control apparatus 9 may be implemented in a centralised or distributed manner.

The controller 20 is operatively coupled to the input interface 22, the output interface 24, and the memory 26. The controller 20 may be implemented purely in hardware (e.g. dedicated hardware or a FPGA), partially in hardware and partially in software, or purely in software, for example as software running on one or more processing units. The input interface 22 and the output interface 24 may each be either an internal or an external interface in the sense that they provide for communications between the controller and an internal component (to the control apparatus) such as e.g. the memory 26 (when internal), or an external component such as e.g. a lighting device (when external). For example, when the controller 20 is implemented in one of the lighting devices 4, the input interface 22 may be an external interface for receiving data from the user device 8 and the output interface 24 may be an internal interface for transmitting control commands to the light source of the lighting device 4. On the other hand, when the controller 20 is implemented in the user device 8, the input interface 22 may be an internal interface for receiving data from an on-board sensor, and the output interface 24 may be an external interface for transmitting control commands to the lighting devices 4.

The memory 26 may be implemented as one or more memory units comprising for example a magnetic medium such as a hard disk, or an electronic medium such as an EEPROM or "flash" memory, or an optical medium such as a CD-ROM, or any combination of such media. The memory 26 is shown in FIG. 2 as forming part of the control apparatus 9, but it may also be implemented as a memory external to the control apparatus 9 such as an external server comprising one or more servers units. These servers units may or may not be the same server units as the servers units providing the lighting network as described herein. In any case, the memory 26 is able to store location and orientation information, along with user preference information. Any of these may be stored in an encrypted form. Note that the location information, orientation information, and user preference information may all be stored on the same memory unit or may be stored on separate memory units. For example, the location and orientation information may be stored on a local memory at the control apparatus 9 while the user preference information is stored on an external server.

The input interface 22 and the output interface 24 allows the controller 20 to receive and transmit data, respectively. Hence, the input interface 22 and the output interface 24 may or may not use different communication protocols. For example, input interface 22 could use a wireless communication protocol such as the WiFi communication standard, whereas output interface 24 could use a wired connection. The input interface 22 and the output interface 24 are shown as separate functional blocks in FIG. 2, but it is understood that they may each comprise one or more multiple interface modules (possibly each interface module using a different communication protocol) and that the input interface 22 and the output interface 24 may comprise one or more of the same interface modules. Hence, it is understood that the control apparatus 9 may comprise only a single interface unit performing both input and output functions, or separate interface units.

The input interface 22 is arranged to receive orientation information indicative of an orientation of the user device 8, location information indicative of a location of the user device 8, and in embodiments an indication of a user preference. In this way, the controller 20 is able to obtain the orientation information and location information (and optionally the indication of the user preference). These may each come directly from the user device 8, or may be obtained from a memory such as memory 26, or an external server of a location service. In either case, the location and orientation information may be indicative of location and orientation values measured by a location sensor and an orientation sensor of the user device 8 in any of the device-centric, network-centric, or hybrid approaches as mentioned above.

Methods for obtaining the locations lighting devices are known in the art. For example, a commissioner during a commissioning phase may manually determine the location of each lighting device 4 and record the respective locations in a database which may comprise a look-up table or a floorplan/map (e.g. stored on memory 26, ideally a centralised memory wherein memory 26 takes the form of a server memory of the lighting network). Controller 20 can then access the locations of the lighting devices from memory 26. Alternatively, or additionally, the locations of each respective lighting device can be determine by the lighting devices themselves using known methods such as triangulation, trilateration etc. in much the same way as the user device 9 location can be determined (as described above). For example, each lighting device could comprise a GPS receiver. Coded light techniques are also known in the art which allow the locations of lighting devices to be determined based on modulating data into the light output from each lighting device (such as a unique ID) and detecting this light using a camera such as a camera of a commissioning tool or other light-sensitive sensor such as a photodiode.

Note that the physical location of a lighting device 4 and the location of a lighting effect rendered by that lighting device 4 are not necessarily co-located (as described above in relation to lighting device 4*d*). For example, a spot light on one side of a room may illuminate a spot on the opposite side of the room. Hence, it is advantageous for the controller 20 to also have access to the lighting effect location(s). The lighting effect location of each respective lighting device may be commissioned (as above in relation to a lighting device itself) or may be determined using other methods such as employing a camera to capture an image of the environment 2 under illumination and then using known methods such as image recognition or coded light to determine the location, and possibly extent, of the lighting effect of each lighting device 4. In embodiments, it may be sufficient to approximate the lighting effect of a lighting device 4 as being co-located with the location of the lighting device 4 itself.

It is also possible to assume a type of lighting pattern generated by a lighting devices based on the type of lighting device (as identified for example during commissioning). For example, a lightstrip will generate a local, diffuse effect, while a spot light has a sharper, more localised, effect. The orientation of the lighting device can be determined based on e.g. gyroscopes and/or accelerometers in each lighting device and combined with the assumed lighting pattern type to determine the lighting effect location. E.g. a spot light facing towards a wall will create a different lighting from a spot light facing downwards from a ceiling.

From the above, it is understood that the controller 20 is able to determine the location and orientation of the user device 8 relative to the lighting devices 4 and/or the respective lighting effect location of each lighting device 4 through any appropriate means. Hence, the controller 20 is able to determine a respective direction, from the location of the user device 8, to a respective lighting effect location of each of the lighting devices 4. Or, as an approximation (as mentioned above), the controller 20 may determine a respective direction, from the location of the user device 8, to a respective lighting device 4, in other words, the heading of the lighting device 4, from the perspective of the user device 8. This direction, or heading, may be relative to the orientation of the user device 8. For example, if the user device 8 is facing north-east and a lighting device is three metres to the east of the user device 8, then the direction of the lighting device may be determined to be +45°, whereas if the user device 8 is facing north-east and a lighting device is three metres to the north of the user device 8, then the direction of the lighting device may be determined to be −45°. Alternatively, the determined directions may be absolute directions defined on some larger reference frame which does not vary as the user device 8 moves, such as cardinal compass directions or headings.

In any case, the controller 20 is able to determine whether a given lighting device 4 falls within a field-of-view (FoV) of the user device 8. The FoV may be defined as the area within a threshold angular range of the orientation of the user device 8 (i.e. the direction in which the user device 8 is pointing, which may be called the heading of the user device 8). The FoV thus changes as the user device 8 moves. For example, the user 6 may indicate a preference of a threshold angular range equal to 90° either side of the heading of the user device 8. In this case, if the user device 8 is facing north, the FoV comprises the area between west, through north, to east, i.e. everything in front of the user device. As another example, the user 6 may indicate a preference of a threshold angular range equal to 90° total (i.e. 45° either side of the user device direction). In this case, if the user device 8 is facing east, the FoV comprises the area between north-east and south-east.

The controller 20 may discount lighting devices even if they appear within the FoV if they are out of range. For example, outside of the environment 2, or the specific room the user device 8 is in, or if the lighting device is outside of a threshold range (i.e. a threshold radial range). The threshold range may be indicated by the user 6 in the user preferences.

It is understood that the controller 20 is able to determine the user preference by any appropriate means. The user 6 may indicate his user preference to the controller directly, e.g. by indicating his preference via a user interface (such as a user interface on user device 8, or a dedicated user interface device). The user preference may be stored in memory (such as memory 26, as described above) for access by the controller 20 at a later point in time. Hence, the controller 20 may determine the user preference by retrieving it from memory. The user preference may indicate for example a preference that lights in front of the user (e.g. in his FoV) are turned on, and lights behind the user (e.g. outside his FoV) are turned off.

The output interface 24 is referred to herein generally as an "output" interface, but insofar as the output interface 24 is for transmitting control commands to the lighting devices 4 it is understood that the output interface 24 may also be referred to as lighting interface 24. Hence, the controller 20 is able to control the lighting devices 4 via the lighting interface 24 by transmitting control commands causing at least one of the lighting devices 4 to change its light output. E.g. to turn on, turn off, dim up, dim down, or in general change hue, intensity, or saturation.

Figure 3A:
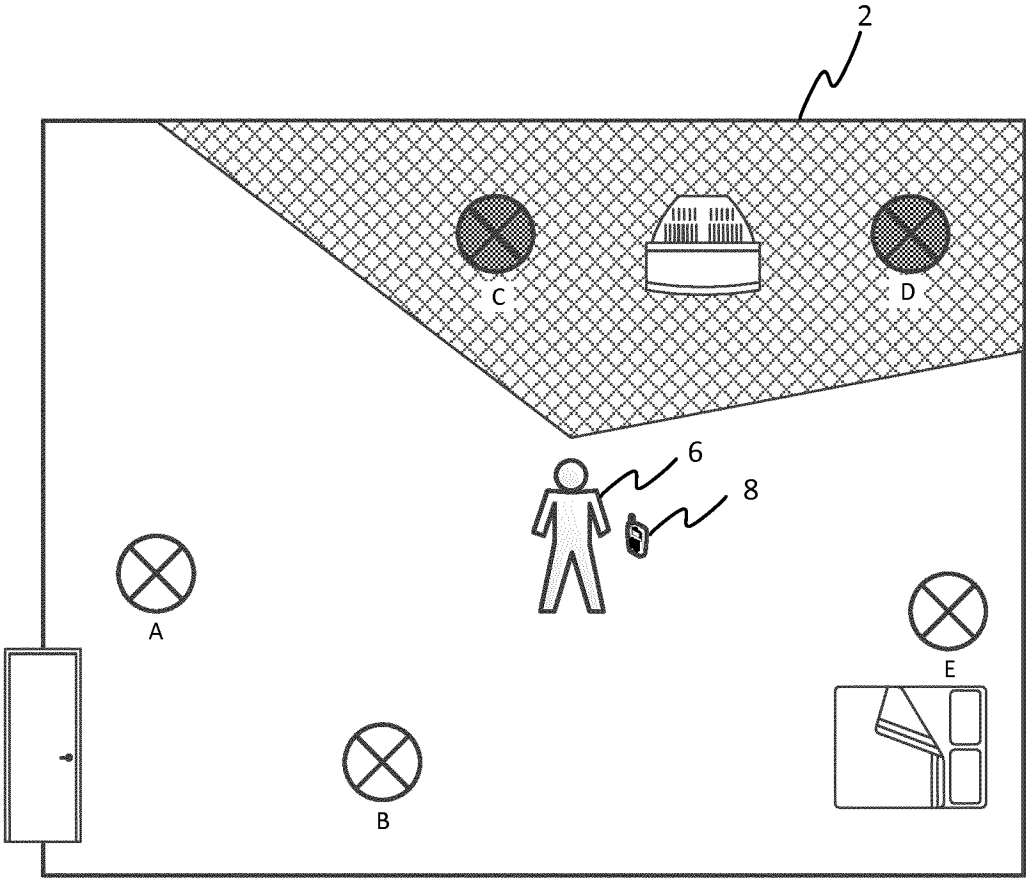
FIGS. 3A-3C illustrate a first example scenario.
Figure 3B:
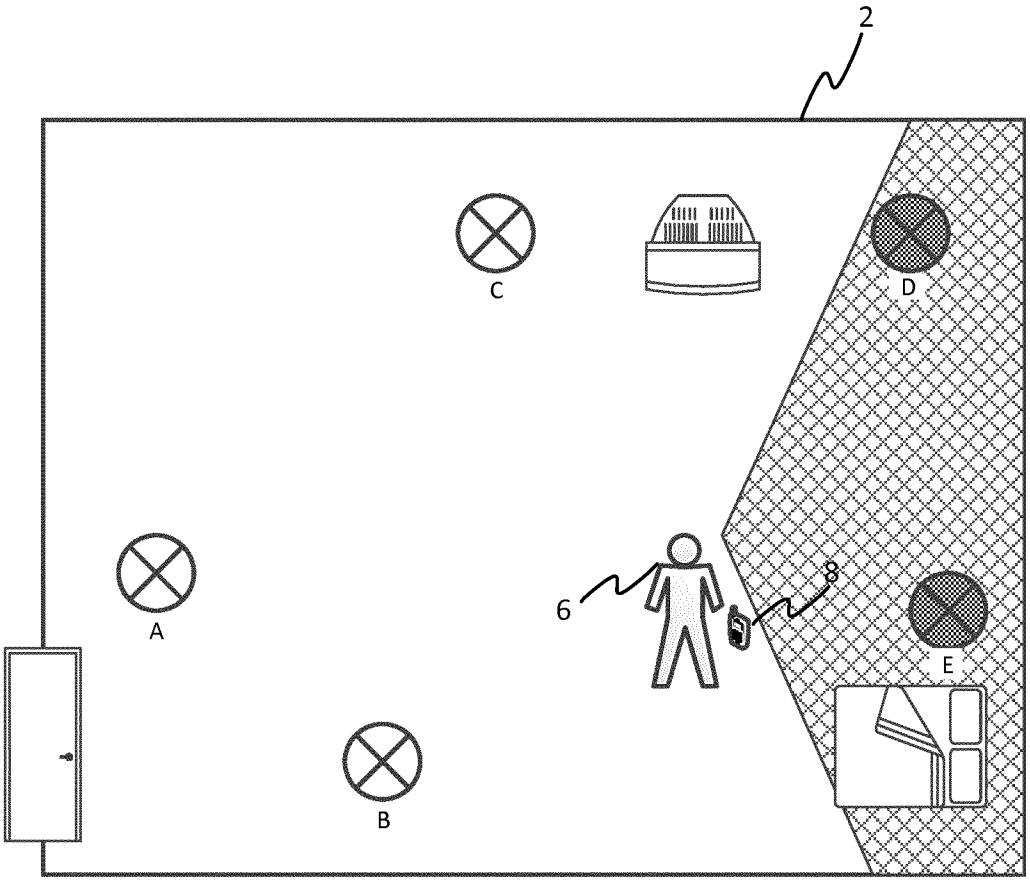
Figure 3C:
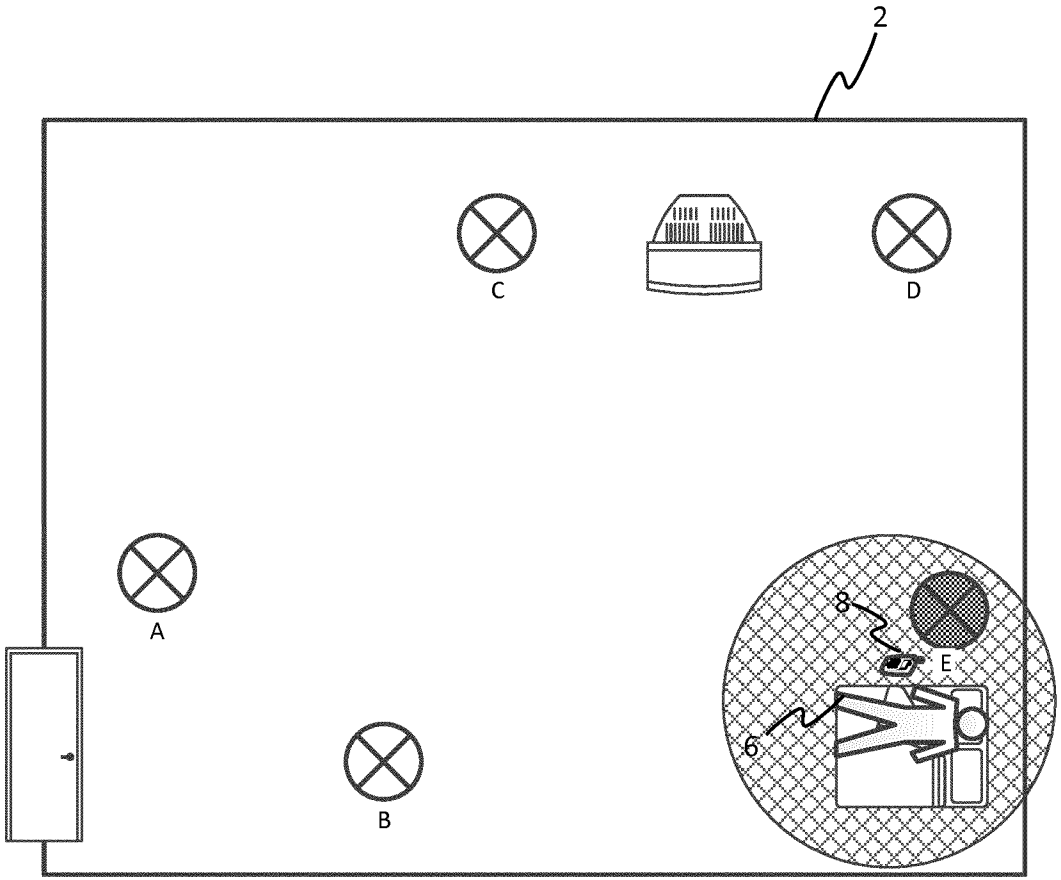

FIGS. 3A-3C illustrate a first example scenario. In this scenario the user 6 is in a room, such as a loft, which contains five light sources A-E. In FIG. 3A, the user 6 is facing only two light source C and light source D. Light sources A, B, and E are at his back at either the entrance or near his bed. For example, the user 6 might be sitting on a couch watching TV. He has therefore chosen a 50% warm white setting for light sources C and D to provide illumination in the room, and has turned the other light sources (A, B, and E) off because they give too much glare on the TV screen.

Later, the user 6 is done watching TV and decides go to bed to do some reading before sleeping. FIG. 3B shows the user 6 on his way to bed. User 8 was sitting looking at the TV but he is now moving and changing orientation. Hence, the user's orientation and location have now changed from the values they were earlier (in FIG. 3A). This is detected by the orientation and location sensors of the user device 8 (as described above). As he moves towards the bed, the system detects that the user was previously facing a 50% warm white scene and re-deploys it along his way towards the bed. That is, the controller 20 is able to determine that light source C has left the user's FoV, light source D remains in the user's FoV, and light source E has entered the user's FoV (and light sources A and B remain outside the user's FoV). The controller 20 can combine this information with the user preference information (i.e. 50% warm white within the FoV) in order to determine appropriate lighting settings. In this case, 50% warm white for light sources D and E, and "off" for light sources A, B, and C.

Finally, the user 6 gets in the bed and starts reading. This is shown in FIG. 3C. In this situation the orientation detected by the orientation sensor indicates that the user 6 is facing upwards, for example by way of an gyroscope, and therefore the controller can determine that the user is lying down. This may mean that the user 6 only needs limited, local lighting. The controller 20 can determine that the user 6 is near to light source E using the location information. Therefore, the system can deploy the 50% warm white scene only to the bedside lamp (light source E) and turns all others to off. In other words, the controller 20 determines new appropriate lighting settings: 50% warm white for light source E, and "off" for light sources A, B, C, and D.

Figure 4A:
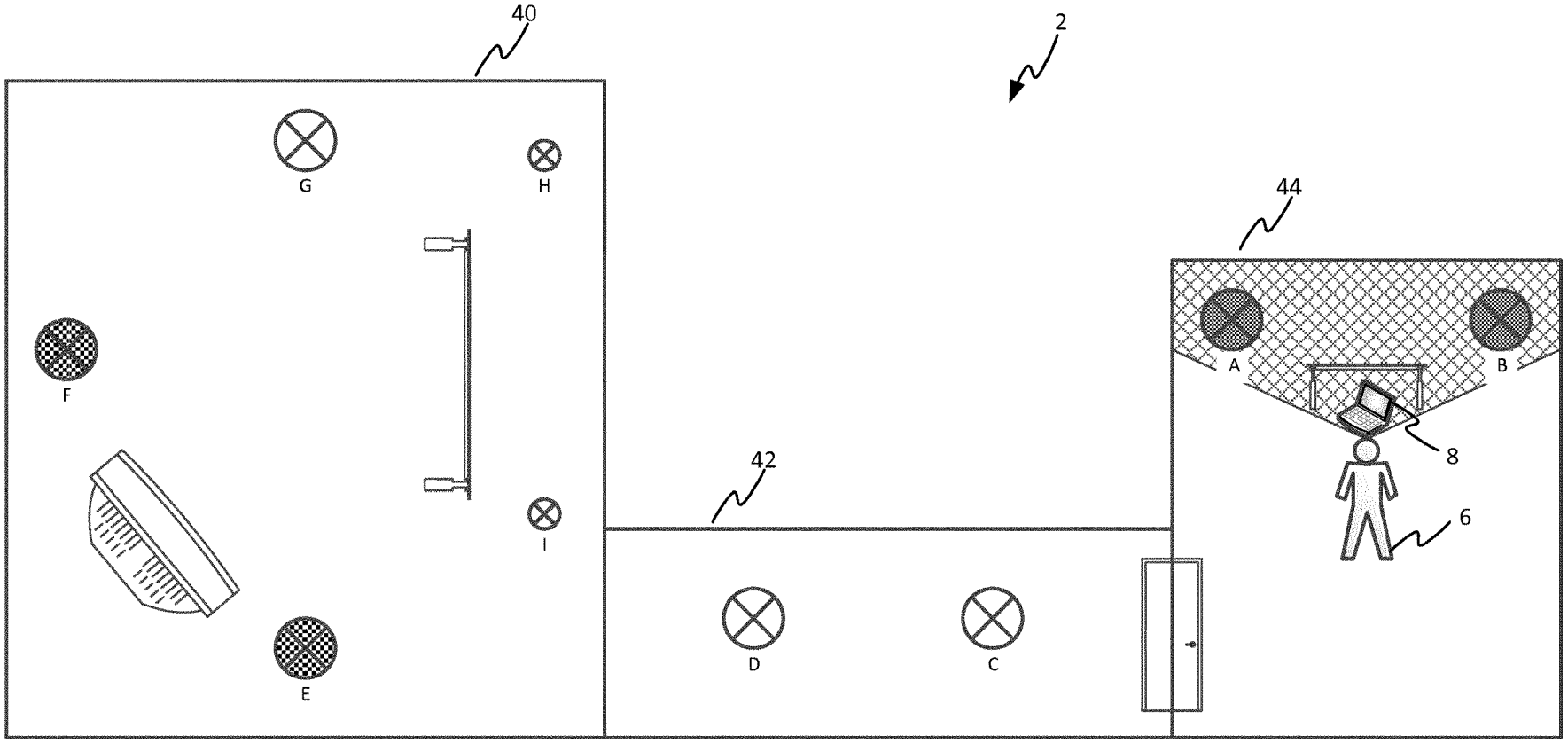
FIG. 4A-4C illustrate a second example scenario.
Figure 4B:
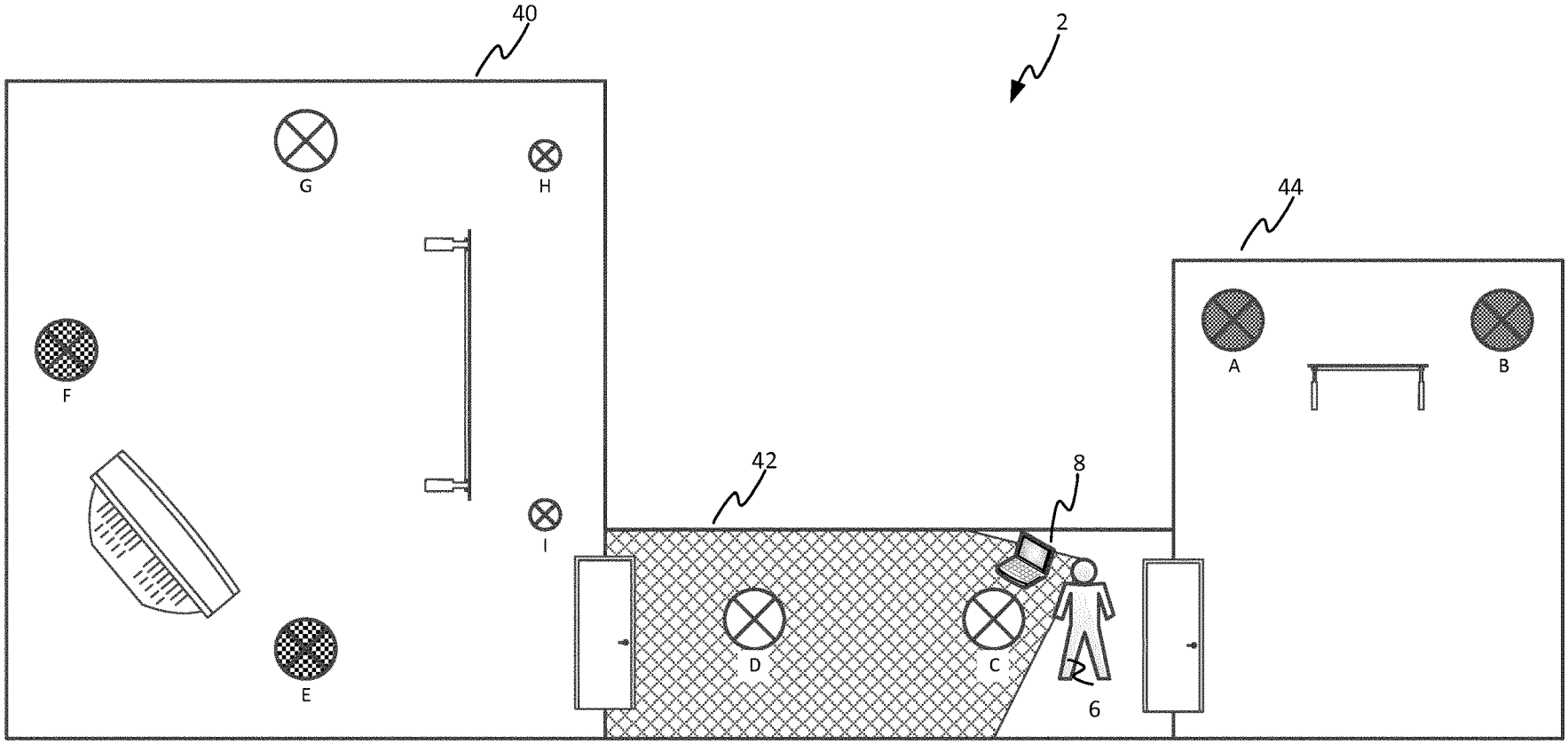
Figure 4C:
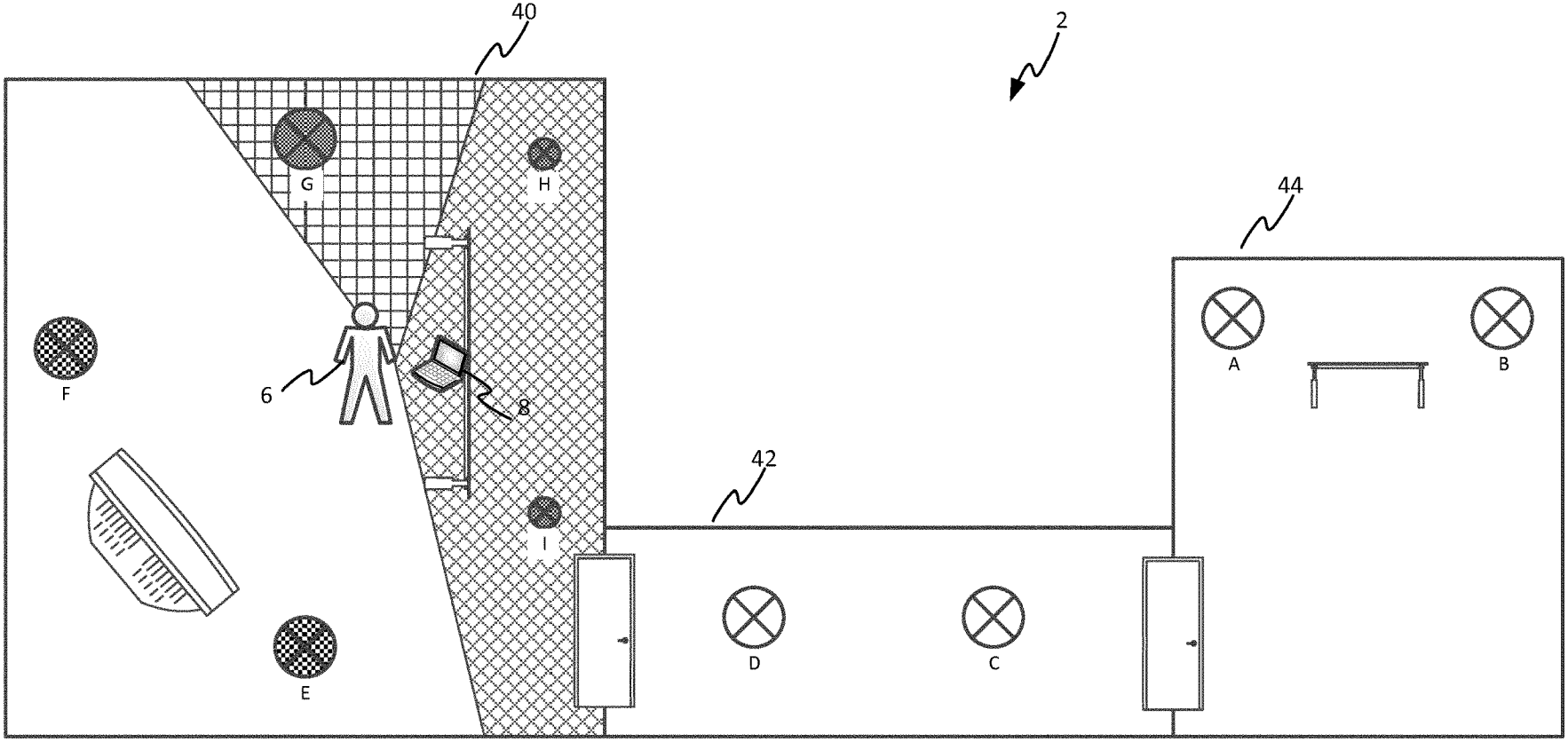

A second example scenario is shown in FIGS. 4A-4C. In this scenario, the environment is a house 2 comprising a living room 40, a corridor 42, and an office 44. There are two light sources A, B in the office 44, two light sources C, D in the hallway 42, and five light sources, E-I, in the living room 40.

To begin with, as illustrated in FIG. 4A, the user 6 is working on her desk in her office 44. She has selected a 100% cool white setting has her user preference to help her concentrate, via her user device 8 which in this case is her laptop. The controller 20 obtains this preference, along with orientation and location information of the laptop (as described above) and processes them to determine lighting settings. In this case, the controller 20 determines that light sources A and B are both within the FoV and hence controls both light source A and light source B to emit light with a 100% cool white setting.

Alternatively, the user preference may be obtained by the controller 20 in a less explicit manner. For example, the controller is able to determine that light sources A and B are within the user's FoV. If then the user 6 controls light sources A and B to emit light with a 100% cool white setting, the controller 20 is able to infer that the user's preference is for a 100% cool white setting for light sources within the FoV.

Later, the user 6 decides to continue working on her living room table since her son is already there playing video games on the TV. Light sources E and F are rendering a dynamic colour scene to compliment the video game.

As the user 6 walks from the office 44 towards the living room 40, she passes through the hallway 42 as shown in FIG. 4B. In this case, there are beacons of a location network (such as Bluetooth devices) in each room which can detect Bluetooth beacons coming from the user's computer as she moves around the house and forward any detected presence information to the controller 20. This is another example of a location sensor. Hence, the controller 20 is able to obtain location information in this manner and determine the user's location. Note that this is a network-centric approach, as described above. Device-centric approaches and hybrid approaches are also possible (also described above).

The system in this scenario includes an additional feature which was not present in the first scenario: the system has a timer delay to ensure that the lights don't immediately change. I.e. the system waits until it is sure that the user 6 is in a static/stable position before enacting any lighting setting alterations. This timer delay may take the form of a refresh rate or frequency. For example, the controller 20 may obtain location and orientation information only on a periodic basis with a period of a few seconds. The period may be configurable and may form part of the user preferences. Alternatively, the controller 20 may obtain location and orientation information as before (for example, if the location and orientation information is "pushed" to the controller 20 by the location and orientation sensors), but only perform the steps of determining lighting settings and controlling the light sources on a periodic basis. In any case, the timer delay is an optional feature which can prevent annoyingly frequent updates to the lighting settings. The timer delay is also advantageous in that a user may move for only a brief moment and then return to their original location and/or orientation. For example, a user may leave a room briefly and then return. In this case the timer delay ensures that the lighting conditions have not changed when the user re-enters the room. This also allows the system to ensure that a user has definitely left the room (and hasn't returned within the delay time) or otherwise moved before enacting lighting setting changes.

It is understood that the controller 20 is also able to determine at least an estimate of the velocity of the user device 8 using at least two instances of the location of the user device 8 if the times at which the respective location values are measured are known. That is, the controller 20 can determine the average speed at which the user device 8 would have had to travel between two locations, as is well known in the art. The controller 20 may also apply a threshold speed (being the magnitude of the velocity) such that the controller 20 does not update any lighting settings if the user device 8 is determined to be moving at a velocity with a magnitude above the threshold speed. The controller 20 may therefore determine that a user is stationary if the determined speed is substantially zero. Note that it is not necessary for the controller 20 to determine the actual speed of the user device 8 in order to determine whether or not to update the lighting settings as described above. That is, the controller 20 may also determine that the user is stationary if the signal coming from at least one beacon is stable for a certain time. This is advantageous in that the controller 20 (or user device 8 in a device-centric approach) saves on processing power by not determining the actual speed of the user device 8. Instead, the controller 20 just looks at whether the signal fluctuates (more than a threshold fluctuation amount due to, e.g. noise) and thereby determines whether the user device 8 is static or not. Hence, the controller 20 may not update one or more lighting settings if the signal from at least one beacon is not low or stable enough.

Returning now to FIG. 4B, as the user 6 walks along the hallway 42, the controller determines that she is in the hallway 42 but moving above the threshold speed. In this case, the controller 20 does not control lights C and D to output the 100% cool white setting (the user preference) despite lights C and D being within the FoV. This may involve controlling lights C and D to remain at their current setting, or may simply involve transmitting no control command to either of light C or light D. The same applies for light sources A and B in the office 44, which also remain the same.

In FIG. 4C, the user 6 has arrived in the living room 40 and sat down at the table. The controller 20 determines from updated location and orientation information that the user device 8 is in the living room 40 and that light sources H and I are within the FoV. The controller 20 also determines that the user device 8 and hence the user 6 is in a more static situation (i.e. her speed is now below the threshold speed). Hence, the controller 20 is able to control light sources H and I to emit light at a 100% cool white setting, in accordance with the user's preferences.

In this case, the controller 20 may also determine that light source G should be set at 50% cool white. This is because even though light source G itself is out of the FoV, it creates a lighting effect at a location between light sources H and I. That is, light source G is brighter than light sources H and I and its brightness contribution does contribute to the overall ambiance within the FoV. Additionally, it helps to "shield" the user 6 from the dynamic effects taking place behind her at light sources E and F, which could "spill" into the FoV. The controller 20 can also choose to implement lighting setting changes if their capabilities don't match those of the original light sources (A and B). E.g. if light sources A and B were bulbs rated at 800 lumens but light sources H and I only 400 lumens, the brightness settings can be increased instead of also adding light source G. In general, the controller 20 will try to render the same ambiance as long as it does not negatively impact the light settings of other lighting devices which are not in the FoV. In other words, the controller 20 may adapt the light output of the lighting devices within the FoV but should only make changes to lighting devices outside the FoV if necessary. Performance limitations may also be considered. E.g. in the above example light source H is not able to output the same brightness as light source A at full brightness (as light source A is rated 800 lumens whilst light source H is only rated 400 lumens). Hence, the controller 20 may simply control light source H to output maximum brightness when in actuality the desired setting would be brighter.

The controller 20 also determines that the light settings for light sources A and B are no longer needed and can therefore be turned off. For example, the controller 20 may determine the user device 8 is no longer in the office 44 based on input from the location sensor.

An extension which may be applied to any of the embodiments described herein is that the lighting settings may also be further adjusted based on other parameters such as the time of day, measured ambient light etc. This is advantageous in that the controller 20 does then not just "blindly" redeploy the lighting settings as the user 6 moved. Instead, the controller 20 is able to adapt the lighting appropriately to the new deployment location.

Methods by which the controller 20 may obtain information indicative of the time of day and/or ambient light levels are therefore determine the time of day and/or ambient light levels, respectively, are known in the art. For example, the control apparatus 9 may comprise a clock device to which the controller 20 is operatively coupled. The clock device may also be a remote clock such as a clock accessed over the internet by the controller 20. Regarding the ambient light level, it is known that the ambient light level (particularly of an outdoor environment) may be estimated based on the time of day, obtained as described above. Alternatively or additionally, the system may comprise one or more light level sensors such as photodiodes which take direct measurements of ambient light levels. These photodiodes can then transmit information indicative of the measured ambient light level to the controller 20 for processing.

In general, this the controller 20 may obtain information indicative of an ambient light level or time of day and determine, from the obtained information, an ambient light level or time of day. The controller 20 is then able to process the determined ambient light level or time of day along with the determined location and orientation in order to determine the lighting settings. As an example, if the user 6 from the second scenario entered a dark room, the 100% cool white setting might be inappropriately dark. Instead, the controller 20 could deploy e.g. a 50% cool white setting so as not to cause discomfort to the user 6. In this example, the controller 20 may determine the lighting settings based on maintaining a constant total lighting level, taking into account contributions from the lighting devices 4 and the ambient light level.

It will be appreciated that the above embodiments have been described only by way of example. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored and/or distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. An apparatus for controlling a plurality of lighting devices to emit light, the apparatus comprising:

a lighting interface for transmitting control commands to each of the plurality of lighting devices in order to control the plurality of lighting devices; and a controller communicably coupled to the lighting interface, wherein the controller is configured to:

obtain orientation information indicative of an orientation of a user device and based thereon determine the orientation of the user device;

obtain location information indicative of a location of the user device and based thereon determine the location of the user device;

determine a respective direction, from the location of the user device, of a respective lighting effect location of each of the one or more lighting devices, said direction being relative to the determined orientation of the user device;

determine a subset of the plurality of lighting devices that are within a field of view of the user device by determining whether each respective direction is within a threshold angular range defining the field of view;

determine what current light settings the user is subjected to;

determine one or more first lighting settings for the subset of the plurality of lighting devices, wherein the one or more first lighting settings is determined such that the user perceives the same overall ambience as the user device moves;

determine a remainder of the plurality of lighting devices not part of the subset by operating outside the field of view of the user device;

determine one or more second lighting settings for the remainder of the plurality of lighting devices; and selectively control, via the lighting interface, the subset of the plurality of lighting devices to emit the light in accordance with the one or more first lighting settings and the remainder of the plurality of lighting devices based on the one or more second lighting settings.

2. The apparatus according to claim 1, wherein the lighting effect location of a lighting device of the subset of the plurality of lighting devices is substantially co-located with the lighting device.

3. The apparatus according to claim 1, wherein the one or more first lighting setting comprises turning on or dimming up the subset of the plurality of lighting devices.

4. The apparatus according to claim 1, wherein the one or more second lighting settings comprises turning off or dimming down the remainder of the plurality of lighting devices.

5. The apparatus according to claim 1, wherein the controller is further configured to obtain an indication of a user preference and process the obtained indication along with the received orientation information and the received location information to determine the one or more first lighting settings for the subset of the plurality of lighting devices.

6. The apparatus according to claim 5, wherein said indication of the user preference is input by a user of the user device and obtained by receiving the indication from the user device.

7. The apparatus according to claim 6, wherein said indication of the user preference is stored in a memory and obtained by retrieving the indication from the memory.

8. The apparatus according to claim 5, wherein the user preference specifies the one or more first lighting settings.

9. The apparatus according to claim 8, wherein the user preference further specifies the one or more second lighting settings.

10. The apparatus according to claim 5, wherein the indication of the user preference comprises a preference of the threshold angular range.

11. The apparatus according to claim 1, wherein the controller is further configured to determine a respective distance from the user device to each of the one or more lighting devices, and not control lighting devices which are determined to be further from the user device than a threshold distance.

12. The apparatus according to claim 1, wherein the controller is further configured to:

obtain, at a subsequent time relative to obtaining the orientation information, subsequent orientation information indicative of a subsequent orientation of the user device and based thereon determine the subsequent orientation of the user device;

obtain, during the subsequent time, subsequent location information indicative of a subsequent location of the user device and based thereon determine the subsequent location of the user device;

determine a respective subsequent direction, from the subsequent location of the user device, of a subsequent respective lighting effect location of each of the one or more lighting devices, said subsequent direction being relative to the subsequent determined orientation of the user device;

determine a subsequent subset of the plurality of lighting devices that are within a subsequent field of view of the user device by determining whether each respective subsequent direction is within a subsequent threshold angular range defining the subsequent field of view;

determine what subsequently current light settings the user is subjected to;

determine one or more third lighting settings for the subsequent subset of the plurality of lighting devices, wherein the one or more third lighting settings is determined such that the user perceives the same overall ambience as the user device moves;

determine a subsequent remainder of the plurality of lighting devices not part of the subsequent subset by operating outside the subsequent field of view of the user device;

determine one or more fourth lighting settings for the subsequent remainder of the plurality of lighting devices; and selectively control, via the lighting interface, the subsequent subset of the plurality of lighting devices to emit the light in accordance with the one or more third lighting settings and the subsequent remainder of the plurality of lighting devices using the one or more fourth lighting settings.

13. The apparatus according to claim 1, wherein the controller is further configured to:

obtain, at a subsequent time relative to obtaining the orientation information, subsequent orientation information indicative of a subsequent orientation of the user device and based thereon determine the subsequent orientation of the user device;

determine a respective subsequent direction, from the subsequent orientation of the user device, of a subsequent respective lighting effect location of each of the one or more lighting devices;

determine a subsequent subset of the plurality of lighting devices that are within a subsequent field of view of the user device by determining whether each respective subsequent direction is within a subsequent threshold angular range defining the subsequent field of view;

determine what subsequently current light settings the user is subjected to;

determine one or more third lighting settings for the subsequent subset of the plurality of lighting devices, wherein the one or more third lighting settings is determined such that the user perceives the same overall ambience as the user device moves;

determine a subsequent remainder of the plurality of lighting devices not part of the subsequent subset by operating outside the subsequent field of view of the user device;

determine one or more fourth lighting settings for the subsequent remainder of the plurality of lighting devices; and selectively control, via the lighting interface, the subsequent subset of the plurality of lighting devices to emit the light in accordance with the one or more third lighting settings and the subsequent remainder of the plurality of lighting devices using the one or more fourth lighting settings.

14. The apparatus according to claim 1, wherein the threshold angular range is centered around the orientation of the user device.

15. The apparatus according to claim 1, wherein the user device comprises a gyroscope.

16. The apparatus according to claim 1, wherein the user device comprises an accelerometer.

17. The apparatus according to claim 1, wherein the location of the user device is determined using a location network.

18. The apparatus according to claim 17, wherein the location network is integrated with the plurality of lighting devices.

19. A method of controlling a plurality of lighting devices to emit light, the method comprising steps of:

receiving orientation information indicative of an orientation of a user device and based thereon determine the orientation of the user device;

receiving location information indicative of a location of the user device and based thereon determine the location of the user device;

determining a respective direction, from the location of the user device, of a respective lighting effect location of each of the one or more lighting devices, said direction being relative to the determined orientation of the user device;

determining a subset of lighting devices that are within a field of view of the user device by determining whether each respective direction is within a threshold angular range defining the field of view;

determining what current light settings the user is subjected to;

determining one or more first lighting settings for the subset of the plurality of lighting devices, wherein the one or more first lighting settings is determined such that the user perceives the same overall ambiance as the user device moves;

determining a remainder of the plurality of lighting devices not part of the subset by operating outside the field of view of the user device;

determining one or more second lighting settings for the remainder of the plurality of lighting devices; and selectively controlling the subset of the plurality lighting devices to emit the light in accordance with the one or more first lighting settings and the remainder of the plurality of lighting devices based on the one or more second lighting settings.

20. A computer program product comprising computer-executable code embodied on a non-transitory storage medium arranged so as when executed by one or more processing units to perform the steps according to claim 19.

* * * * *